US009259032B2

(12) United States Patent
Atas

(10) Patent No.: US 9,259,032 B2
(45) Date of Patent: Feb. 16, 2016

(54) CIGARETTE MOUTHPIECE WITH FILTER HAVING MULTIPLE MINI FILTER HOLES

(76) Inventor: Fahrettin Atas, Istanbul (TR)

( * ) Notice: Subject to any disclaimer, the term of this patent is extended or adjusted under 35 U.S.C. 154(b) by 109 days.

(21) Appl. No.: 14/342,386

(22) PCT Filed: Apr. 14, 2011

(86) PCT No.: PCT/TR2011/000080

§ 371 (c)(1),
(2), (4) Date: Mar. 2, 2014

(87) PCT Pub. No.: WO2012/141662

PCT Pub. Date: Oct. 18, 2012

(65) Prior Publication Data

US 2014/0224264 A1 Aug. 14, 2014

(51) Int. Cl.

| | |
|---|---|
| ***A24F 13/02*** | (2006.01) |
| ***A24F 7/04*** | (2006.01) |
| ***A24D 1/04*** | (2006.01) |
| ***A24D 3/04*** | (2006.01) |

(52) U.S. Cl.
CPC ... *A24F 7/04* (2013.01); *A24D 1/04* (2013.01); *A24D 3/045* (2013.01)

(58) Field of Classification Search
CPC ..... A24D 3/045; A24F 13/06; A24F 7/04
USPC ..... 131/175, 187
See application file for complete search history.

(56) References Cited

U.S. PATENT DOCUMENTS

| | | | | |
|---|---|---|---|---|
| 3,172,410 A | | 3/1965 | Miller | |
| 4,209,026 A | * | 6/1980 | Dock | 131/187 |
| 4,574,820 A | * | 3/1986 | Pinkerton et al. | 131/339 |

FOREIGN PATENT DOCUMENTS

| | | | |
|---|---|---|---|
| DE | 19634760 | A1 | 3/1997 |
| EP | 0125027 | A1 | 11/1984 |
| FR | 1365712 | A | 7/1964 |
| GB | 2113069 | A | 8/1983 |

* cited by examiner

*Primary Examiner* — Richard Crispino
*Assistant Examiner* — Dionne Walls Mayes
(74) *Attorney, Agent, or Firm* — Andrew W. Chu; Craft Chu PLLC

(57) ABSTRACT

The cigarette mouthpiece with filter provides ease in smoking and enables the filtration of harmful substances like nicotine, tar, etc. contained in the cigarette smoke. The cigarette mouthpiece includes a hollow body having a positioning portion inside where the cigarette is fixed and an extension entering the mouth region of the smoker, and a filter with multiple filter holes placed inside of the body.

3 Claims, 2 Drawing Sheets

CIGARETTE MOUTHPIECE WITH FILTER HAVING MULTIPLE MINI FILTER HOLES

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to a cigarette mouthpiece with filter, to the tip portion of which the cigarette is fixed, which provides ease in smoking and which enables the harmful substances contained in the cigarette smoke to be filtered.

2. Description of Related Art Including Information Disclosed Under 37 CFR 1.97 and 37 CFR 1.98.

Today, considering the very widespread nature of the smoking habit, the cigarette mouthpieces with filter are used with a view to provide that the individuals who can not quit smoking are exposed to a minimum level of harm caused by the cigarette smoke. The existing cigarette mouthpieces with filter are comprised by two parts, namely an outer body and an inner filter placed into the outer body. The manufacture is completed by subsequently mounting the filter mechanism into the body. The outer body consists of a hollow cylindrical portion, into which the cigarette is positioned, and a hollow extension, which is formed integral with the cylindrical portion and is positioned with an ergonomic structure in a way to suit the gap between the two lips of the smoker. The extension generally has a non-cylindrical structure that flattens towards the tip thereof entering the mouth.

The filter is positioned between the cylindrical portion of the outer body and the extension, wherein each filter comprises a conical portion that facilitates the collection of the cigarette smoke, and a cylindrical portion that plays a role in the retention (filtering) of the tar and the nicotine. The number and the size of the filters used in a cigarette mouthpiece are very important. An increased number of filters enables both ease in smoking and a significant degree of filtration for the cigarette smoke. Although the product has a simple structure, it involves very serious precision requirements regarding the manufacture thereof in a functional manner. When the diameter of the cylindrical portion of the filters is large, the filtration process may not be carried out as a result of the direct passage of the smoke. On the other hand, when said diameter is small, the smoking becomes difficult or impossible due to the very low amount of smoke that is received. For this reason, there is the necessity for the diameter of the cylindrical portion of the filters to be in optimum size. It was determined that the tolerance range should be limited to the value of +20 microns (0.02). The number for filters used in the existing cigarette mouthpieces is four. Inability to increase the number of filters as a result of the manufacturing limitations causes the inability to provide a desired level of ease in smoking and of the filtration process. In the most precise CNC machines used for the production of the molds that carry out the stamping of the product, there is a tolerance margin of 0.01. The shrinkage for the polyethylene and eltex raw materials varies in the range 0.020-0.035.

The product according to the invention has emerged from the need to develop a novel filter in order to increase the number of filter holes used in the existing cigarette mouthpieces and to provide the cylindrical portion of the filter hole with the optimum size values.

SUMMARY OF THE INVENTION

The object of the invention is to provide both an ease in smoking (ease of smoke passage) and a high rate of the filtration for the tar and nicotine content present in the cigarette smoke, owing to increasing the number of filter holes used in the cigarette mouthpieces and to bringing the diameter of the cylindrical portion of the filter hole to the new optimum size values determined as a result of the intensive R&D studies.

In the cigarette mouthpiece according to the invention, at least six filter holes are used on the filter surface with a constant diameter of 7 mm. It is also possible to manufacture, according to the preference, the mouthpiece in a way to include eight and ten filter holes. As a result of the cigarette smoke passing and being filtered through at least six points instead of four on the same constant area, the cigarette smoke is enabled to pass more easily and a higher proportion of nicotine and tar to be filtered out of the cigarette smoke. In this way, the smoker is enabled to be exposed to the minimum level of harm resulting from the cigarette smoke.

REFERENCE NUMBERS

Figure 1:
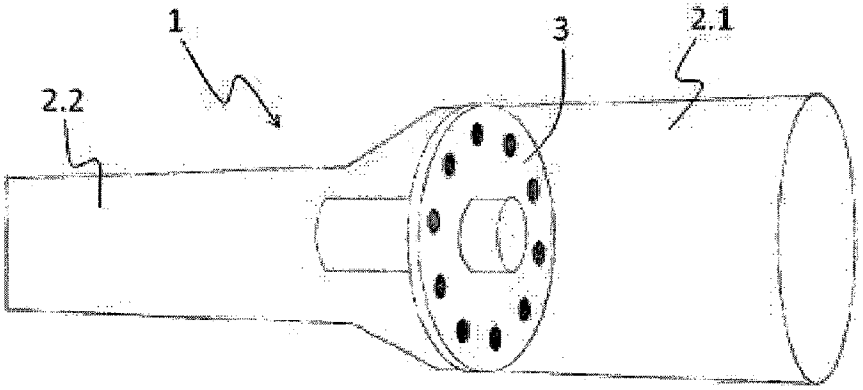
FIG. 1 is a perspective view of the cigarette mouthpiece with filter according to the invention.

1. Cigarette mouthpiece with filter
2. Body
2.1 Positioning portion (where the cigarette is fitted) 2.2 Extension (part entering between the lips)
3. Filter
3.1 Filter surface
3.2 Filter hole section
3.2.1 Conical portion
3.2.2 Cylindrical portion

DETAILED DESCRIPTION OF THE DRAWINGS

The present invention relates to a cigarette mouthpiece (1), to the tip portion of which the cigarette is fixed, said mouthpiece comprising the mini filters that provide ease in smoking and that enable the harmful substances like nicotine, tar, etc. contained in the cigarette smoke to be filtered.

Figure 2:
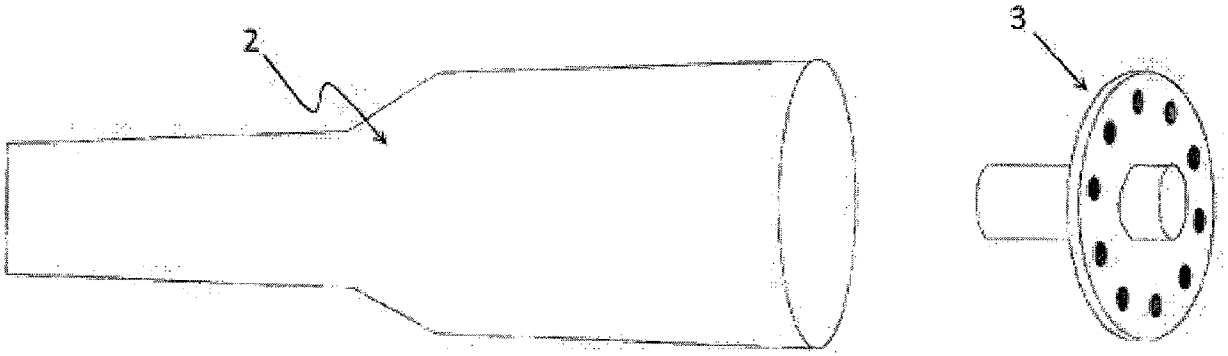
FIG. 2 is an exploded perspective view of the body and the filter of the cigarette mouthpiece.

In FIG. 1, the perspective view of the cigarette mouthpiece (1) with filter according to the invention is provided, while in FIG. 2 the exploded perspective view thereof is provided. The cigarette mouthpiece (1) with filter is comprised by a body (2) and a filter (3) placed inside of the body (2). The body (2) consists of a positioning portion (2.1) inside which the cigarette is fitted and an extension (2.2) entering between the lips of the smoker. The positioning portion (2.1) and the extension (2.2) are formed integral with each other, wherein the interior of the body (2) has a hollow structure.

Figure 3:
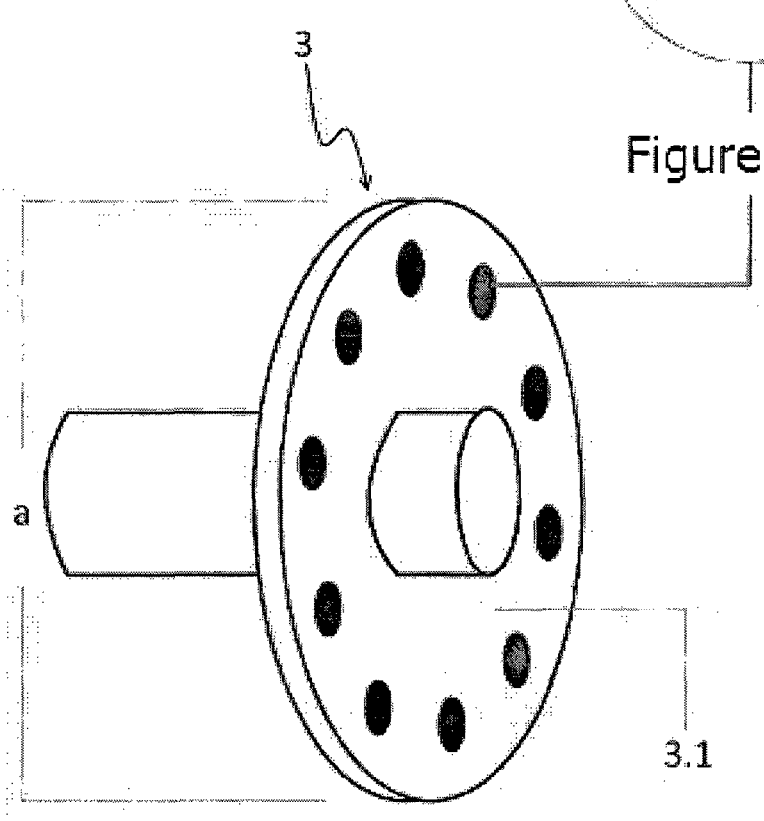
FIG. 3 is a perspective view of the filter.

In FIG. 3, the structure of the filter (3) may be seen. The filter holes (3.2) in circular shape are formed at certain intervals on the circular filter surface (3.1) of the filter (3). The number of the filter holes (3.2) formed on the filter surface (3.1) is at least six.

Figure 4:
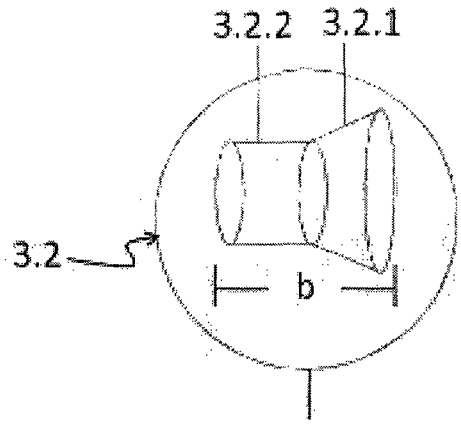
FIG. 4 is a detailed view of the filter hole.

In FIG. 4, the structure of the filter holes (3.2) may be seen. Each filter hole (3.2) is comprised by a conical portion (3.2.1) that facilitates the collection of the cigarette smoke and a cylindrical portion (3.2.2) that plays a role in the retention (filtration) of the harmful substances like tar, nicotine, etc. At least six filter holes (3.2) are used on the filter surface (3.1) of the filter (3). The number of filter holes (3.2) may optionally be increased to eight or ten.

I claim:

1. A cigarette mouthpiece, comprising:

a hollow body being comprised of a positioning portion having a first diameter so as to fit a cigarette, and an extension having a second diameter smaller than said first diameter, said extension having a conical transition portion from an end adjacent said positioning portion being narrowed to said second diameter; and a filter being comprised of a disc and post, said filter placed inside said positioning portion of said hollow body with said disc being friction fit against said conical transition portion so as to align said post with said extension, said disc having a filter surface, wherein at least six filter holes in circular shape are formed at certain intervals on said filter surface, and wherein each filter hole comprises a conical portion so as to facilitate collection of cigarette smoke and a cylindrical portion so as to contribute to retention of substances, each conical portion being oriented with said conical transition portion so as to narrow towards said extension.

2. Cigarette mouthpiece according to claim 1, wherein said filter surface has a diameter of at least a diameter of the cigarette.

3. Cigarette mouthpiece according to claim 1, wherein said filter hole has a length of 1 mm.

* * * * *